US010992062B2

(12) United States Patent
Liu et al.

(10) Patent No.: US 10,992,062 B2
(45) Date of Patent: Apr. 27, 2021

(54) ANTENNA, ANTENNA ARRAY AND BASE STATION

(71) Applicant: AAC Technologies Pte. Ltd., Singapore (SG)

(72) Inventors: Jianchuan Liu, Shenzhen (CN); Yuehua Yue, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 5 days.

(21) Appl. No.: 16/703,830

(22) Filed: Dec. 4, 2019

(65) Prior Publication Data

US 2020/0212597 A1 Jul. 2, 2020

(30) Foreign Application Priority Data

Dec. 28, 2018 (CN) ..... 201811628329.7

(51) Int. Cl.
*H01Q 21/24* (2006.01)
*H01Q 9/04* (2006.01)
(Continued)

(52) U.S. Cl.
CPC ..... *H01Q 21/245* (2013.01); *H01Q 9/0435* (2013.01); *H01Q 9/0464* (2013.01); *H01Q 21/205* (2013.01); *H01Q 21/26* (2013.01)

(58) Field of Classification Search
CPC .... H01Q 21/245; H01Q 21/205; H01Q 21/26; H01Q 9/0435; H01Q 9/0464
See application file for complete search history.

(56) References Cited

U.S. PATENT DOCUMENTS 3,691,560 A * 9/1972 Hammack ..... G01S 13/58 342/387
4,812,782 A * 3/1989 Ajioka ..... H01P 5/12 330/286
(Continued)

FOREIGN PATENT DOCUMENTS

CN 105449361 A1 3/2016
CN 105655702 A1 6/2016
(Continued)

OTHER PUBLICATIONS

PCT search report dated Jan. 16, 2020 by SIPO in related PCT Patent Application No. PCT/CN2019/110988 (9 Pages).

*Primary Examiner* — Lam T Mai
(74) *Attorney, Agent, or Firm* — W&G Law Group LLP

(57) ABSTRACT

The embodiments disclose an antenna, an antenna array and a base station. The antenna includes two pairs of oscillator units that are orthogonal in polarization and have a same structure, each pair of oscillator units comprising a radiating portion and a feeding portion; the radiating portion includes a radiating substrate and two radiating bodies disposed on a surface of the radiating substrate; the radiating bodies are spaced apart from and symmetrical to each other, the feeding portion includes a feeding substrate, a ground disposed on a surface of one side of the feeding substrate and a microstrip disposed on a surface of the other side of the feeding substrate; the radiating substrate and the feeding substrate are perpendicular to and connected to each other, the ground is connected to the radiating bodies, and the microstrip line is spaced apart from and coupled to the radiating bodies.

17 Claims, 11 Drawing Sheets

(51) Int. Cl.
*H01Q 21/20* (2006.01)
*H01Q 21/26* (2006.01)

(56) References Cited

U.S. PATENT DOCUMENTS

| | | | | | |
|---|---|---|---|---|---|
| 4,901,369 | A * | 2/1990 | Momose | H01Q 1/125 | 342/361 |
| 5,592,185 | A * | 1/1997 | Itabashi | H01Q 3/2682 | 343/767 |
| 5,675,295 | A * | 10/1997 | Brebels | H01L 21/8252 | 257/E21.697 |
| 6,657,577 | B1 * | 12/2003 | Gregersen | H01Q 3/04 | 342/22 |
| 9,190,732 | B2 * | 11/2015 | Fujii | H01Q 1/38 | |
| 9,198,450 | B2 * | 12/2015 | Ewald | A23L 5/13 | |
| 9,634,397 | B2 * | 4/2017 | Lee | H01Q 13/085 | |
| 2003/0043071 | A1 * | 3/2003 | Lilly | H01Q 3/2605 | 342/368 |
| 2009/0213010 | A1 * | 8/2009 | Chou | H01Q 9/0428 | 343/700 MS |
| 2009/0304100 | A1 * | 12/2009 | Brehler | H04L 5/0007 | 375/260 |
| 2010/0136927 | A1 * | 6/2010 | Rofougaran | H04B 7/0871 | 455/84 |
| 2011/0291905 | A1 * | 12/2011 | Liu | H01Q 9/26 | 343/797 |
| 2015/0207235 | A1 * | 7/2015 | Lee | H01Q 21/24 | 343/767 |
| 2015/0364831 | A1 * | 12/2015 | Li | H01Q 21/08 | 343/816 |
| 2016/0087334 | A1 * | 3/2016 | Sayama | H01Q 9/16 | 343/820 |
| 2016/0226148 | A1 * | 8/2016 | Ashida | H01P 5/087 | |
| 2017/0077599 | A1 * | 3/2017 | Sayama | H01Q 1/48 | |
| 2018/0323509 | A1 * | 11/2018 | Ogawa | H01Q 3/26 | |
| 2020/0091608 | A1 * | 3/2020 | Alpman | H01Q 21/24 | |
| 2020/0411964 | A1 * | 12/2020 | Li | H01Q 1/246 | |
| 2020/0411966 | A1 * | 12/2020 | Zhu | H01Q 9/0407 | |

FOREIGN PATENT DOCUMENTS

| | | | |
|---|---|---|---|
| CN | 205543223 | B1 | 8/2016 |
| CN | 107069197 | A1 | 8/2017 |
| CN | 207883897 | B1 | 9/2018 |

* cited by examiner

ANTENNA, ANTENNA ARRAY AND BASE STATION

TECHNICAL FIELD

The embodiments of the present application relate to the field of communication technology, and in particular to an antenna, an antenna array and a base station.

BACKGROUND

The Ministry of Industry and Information Technology has issued licenses for the usage of low-frequency test bands in 5G systems to China Telecom, China Mobile and China Unicom. Among them, China Mobile has obtained frequency bands of 2.515-2.685 GHz and 4.8-5 GHz, and China Telecom and China Unicom has obtained a frequency band of 3.4-3.6 GHz. This fully reflects on supporting 5G international standards and technology verification and accelerating the development of 5G industry. Massive multi-input multi-output antenna technology (Massive MIMO) is undoubtedly one of the most critical technologies in 5G systems.

Adopting large-scale antennas can significantly increase spectrum efficiency, especially when capacity requirements are large or coverage is wide, which enables 4G networks to meet network growth requirements. From the operator's point of view, this technology has a good prospect, and it should be implemented in 5G hardware in advance, and 5G air interface function should be provided through software upgrade to facilitate 5G deployment.

Massive Multiple Input Multiple Output (Massive MIMO) technology has the following advantages:

With Massive MIMO antenna arrays, the spectral efficiency is 3 to 5 times greater than that of ordinary macro base stations.

Massive MIMO increases the flexibility of network coverage, and the operators may utilize horizontal and vertical coverage features of Massive MIMO to provide coverage in different scenarios.

With amazing high-capacity gains, Massive MIMO is expected to help the operators to draw users by machine-flexible billing policies, which provides an incomparable user experience, stimulates the user's data consumption, gains traffic revenue, and increases the operator's income.

Massive MIMO is compatible with 4G terminals, and the operators can now benefit from 4G network deployments. At the same time, it also supports 5G-oriented network evolution to maintain and enhance the return of existing investments.

It can be seen that in order to realize the technical advantages of Massive MIMO, how to design a Massive MIMO antenna is an urgent problem to be solved.

It should be noted that the information disclosed in this section are only used for better understanding of the background of the present disclosure, and thus it may include information that does not constitute prior art known to those of ordinary skill in the art.

BRIEF DESCRIPTION OF THE DRAWINGS

One or more embodiments are exemplified for illustration by the corresponding figures in the accompanying drawings, while the illustration shall not be construed as a limitation to the embodiments. Elements with the same reference numerals in the Drawings refer to the like elements, unless otherwise stated. The figures in the Drawings do not constitute a scale limitation.

DETAILED DESCRIPTION

Figure 1:
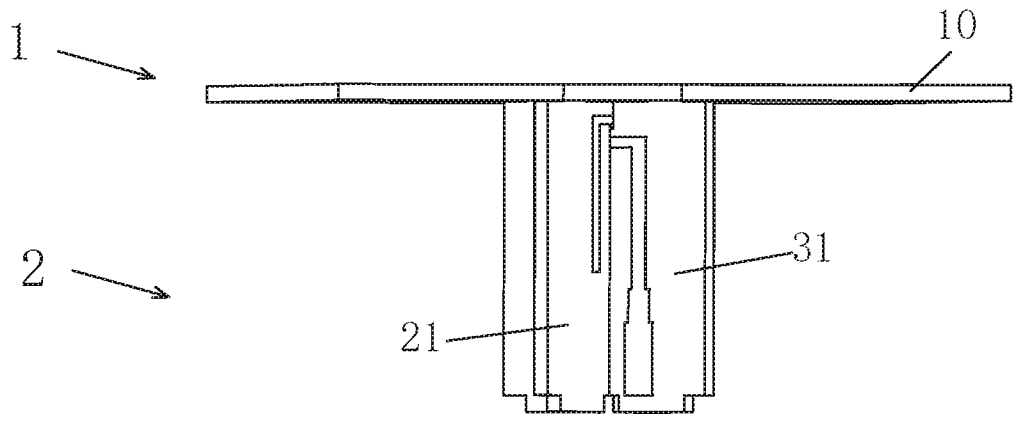
FIG. 1 is a side view of an antenna according to a first embodiment of the present application.

In order to make the objects, technical solutions and advantages of the embodiments of the present application more clear, the embodiments of the present application will be described in detail below with reference to the accompanying drawings. However, those skilled in the art will appreciate that in the various embodiments of the present application, numerous technical details are set forth so that the reader may better understand the application. However, the technical solutions claimed in the present application may also be implemented without these technical details and various changes and modifications made based on the following embodiments.

It should be noted that the terms "first", "second" and the like in the description, claims and the above-mentioned drawings of the present application are used to distinguish similar objects, but do not necessarily refer to a specific order or sequence.

A first embodiment of the present application relates to an antenna, including: two pairs of oscillator units that are orthogonal polarized and have the same structure, each pair of oscillator units includes a radiating portion and a feeding portion for feeding the radiating portion. The radiating portion comprises a radiating substrate and two radiating bodies disposed on a surface of the radiating substrate, wherein, the radiating bodies spaced apart from and symmetrical to each other; the feeding portion comprises a feeding substrate, a ground disposed on a surface of one side of the feeding substrate and a microstrip line disposed on a surface of the other side of the feeding substrate. The radiating substrate and the feeding substrate are perpendicular and connected to each other, the ground is connected with the radiating bodies, and the microstrip line is spaced apart from and coupled to the radiating bodies For convenience of explanation, the two oscillator units are respectively named as a first oscillator unit and a second oscillator unit, and the first oscillator unit and the second oscillator unit have the same structure.

Specifically, as shown in FIGS. 1-4, the radiating portion 1 of the first oscillator unit includes a radiating substrate 10 and a first radiating body 11 and a second radiating body 12 disposed on the radiating substrate 10, and the feeding portion 2 includes a first feeding substrate 21, and a ground 22 and a microstrip line 24 disposed on two respective sides of the first feeding substrate 21. The radiating portion 1 of the second oscillator unit includes a third radiating body 13 and a fourth radiating body 14, and the feeding portion 2 includes a second feeding substrate 31, and a ground 32 and a microstrips 34 disposed on two respective sides of the second feeding substrate 31. It should be noted that in the present embodiment, the first oscillator unit and the second oscillator unit share one radiating substrate 10.

In one particular implementation, the feeding substrates of the first oscillator unit and the second oscillator unit are snap-fitted. A long slit 210 is disposed on the first feeding substrate 21, and a short slit 310 is disposed on the second feeding substrate 31. The long slit 213 and the short slit 323 are snap-fitted, so that the first oscillator unit and the second oscillator unit are connected in an orthogonal snap-fitting way.

It should be noted that the manner of orthogonal snap-fitting by providing the long slit 213 on the first feeding substrate 21 and providing the short slit 313 on the second feeding substrate 31 is merely illustrative, and other snap-fitting ways are possible based on the structure features of the first feeding substrate 21 and the second feeding substrate 31. The present invention is not limited thereto.

Figure 2:
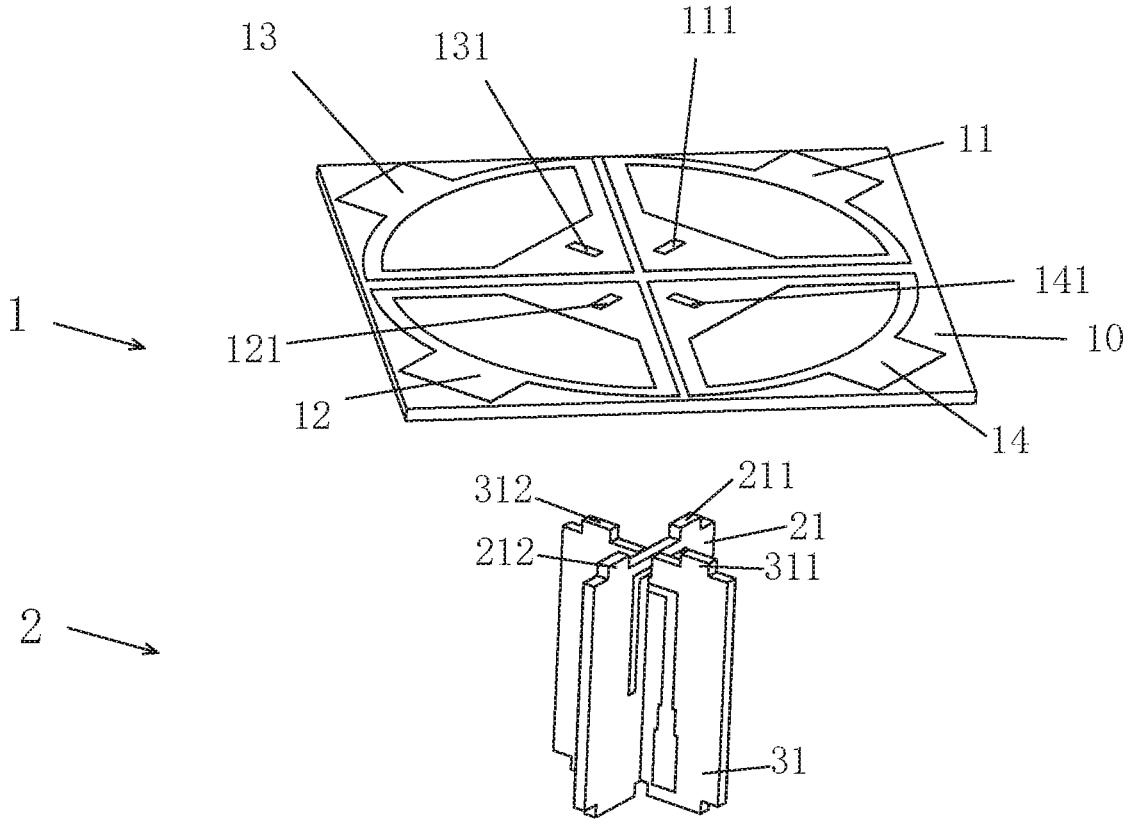
FIG. 2 is an exploded view of the antenna according to the first embodiment of the present application.
Figure 3:
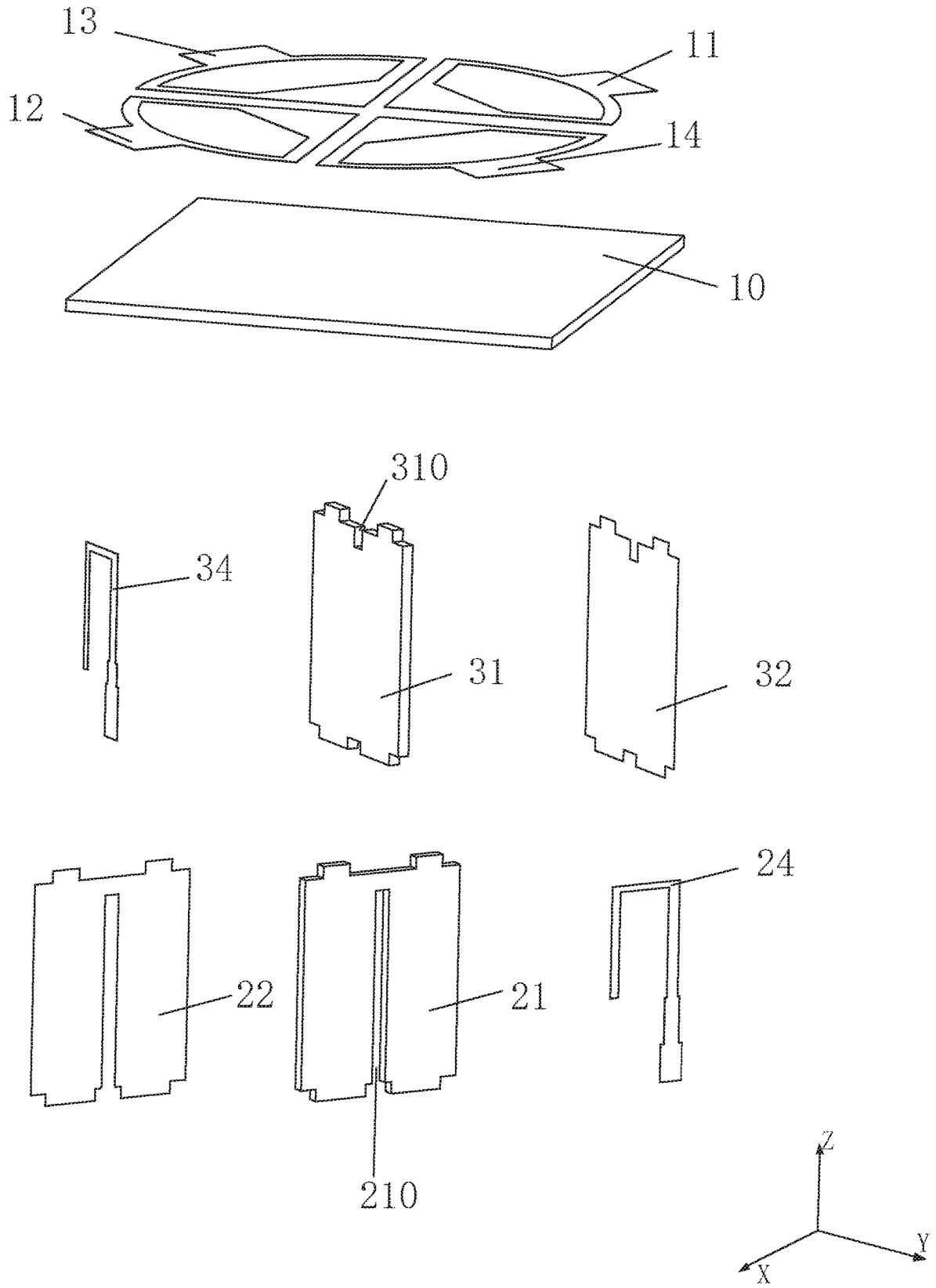
FIG. 3 is another exploded view of the antenna according to the first embodiment of the present application.

In one particular implementation, the radiating substrate and the feeding substrate of each oscillator unit are snap-fitted. As shown in FIG. 2, the first feeding substrate 21 and the second feeding substrate 31 are each provided with projections, the radiating substrate 10 is provided with notches, and the shape of the notches matches with the shape of the projections, thereby the radiating substrate 10 and the first feeding substrate 21 and the second feeding substrate 31 are snap-fitted. The projections on the first feeding substrate 21 includes a first projection 211 and a second projection 212; the projections on the second feeding substrate 31 includes a third projection 311 and a fourth projection 312. Correspondingly, the notches on the radiating substrate 10 includes a first notch 111, a second notch 121, a third notch 131 and a fourth notch 141.

Figure 5:
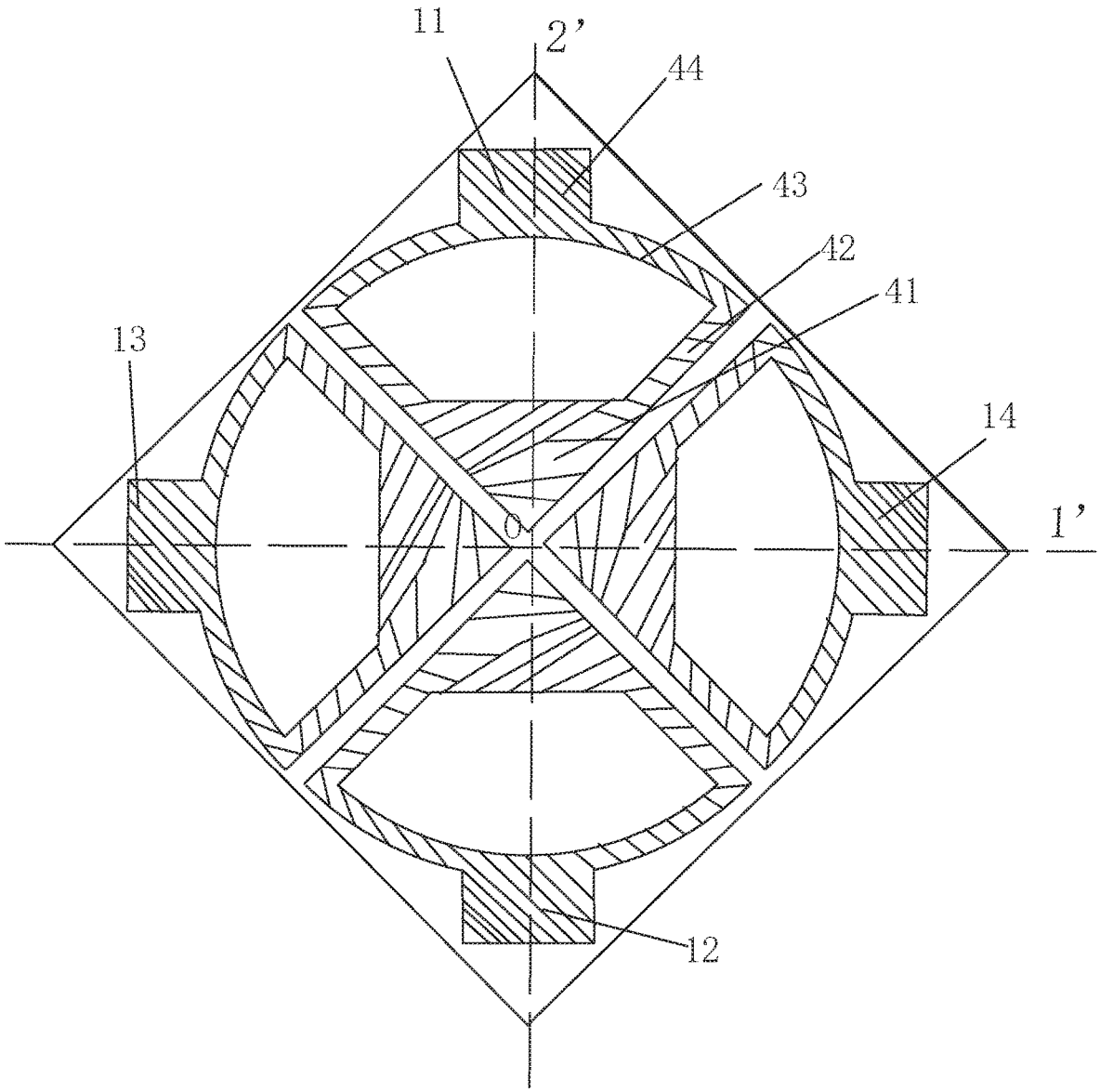
FIG. 5 is a structural diagram of a radiating portion of the antenna according to the first embodiment of the present application.
Figure 6:
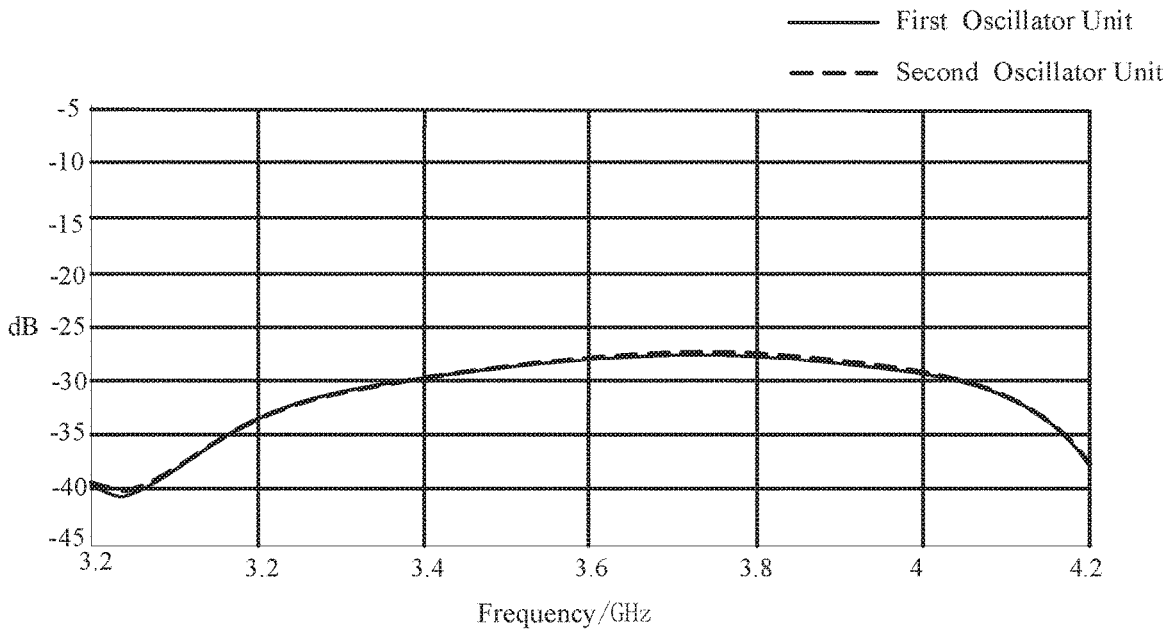
FIG. 6 illustrates an isolation degree of an antenna oscillator of a coupling-feeding portion according to the first embodiment of the present application.
Figure 7:
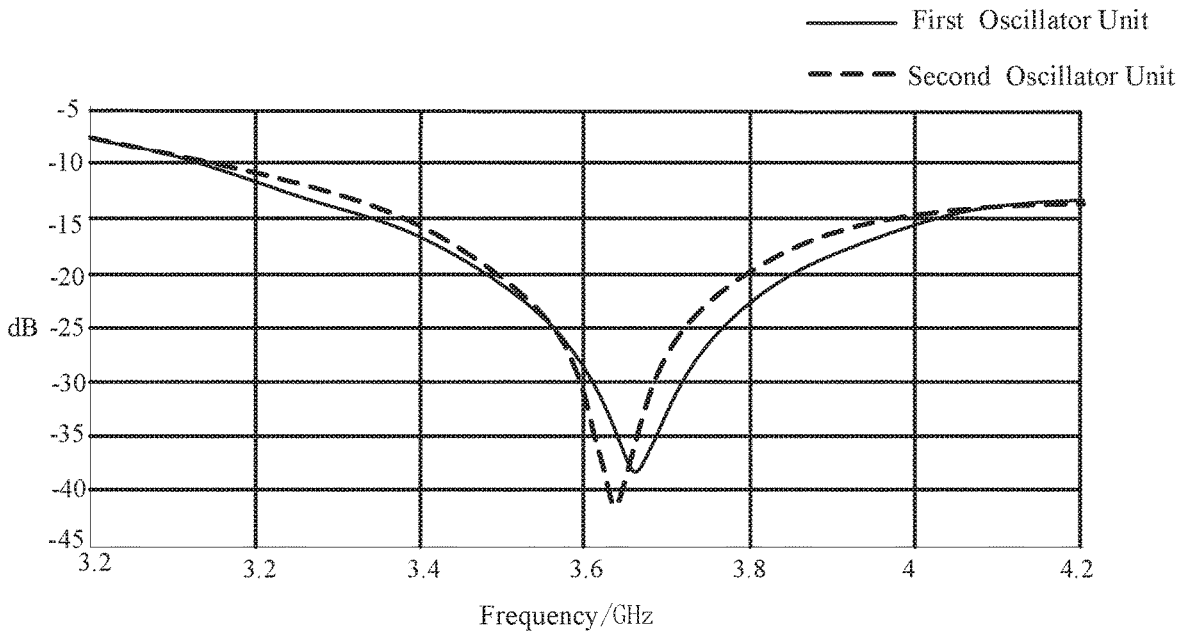
FIG. 7 illustrates a reflection coefficient of the coupling-feeding portion according to the first embodiment of the present application.
Figure 8:
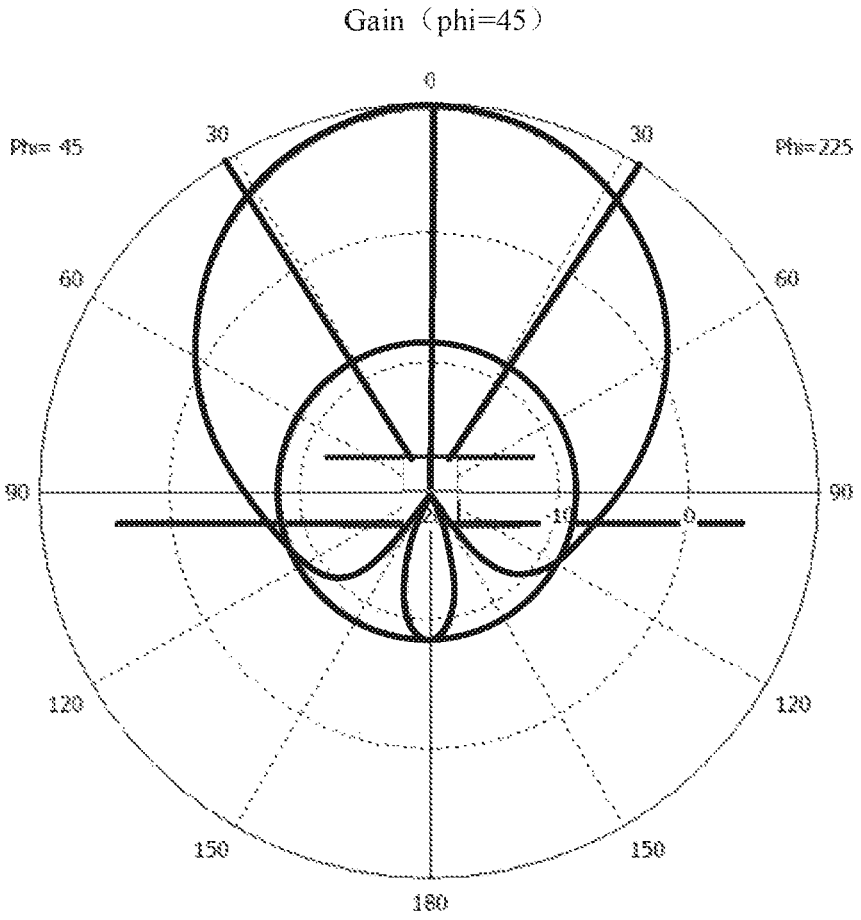
FIG. 8 illustrates a pattern of a first oscillator unit of the antenna according to the first embodiment of the present application in a plane of Phi=45°.
Figure 9:
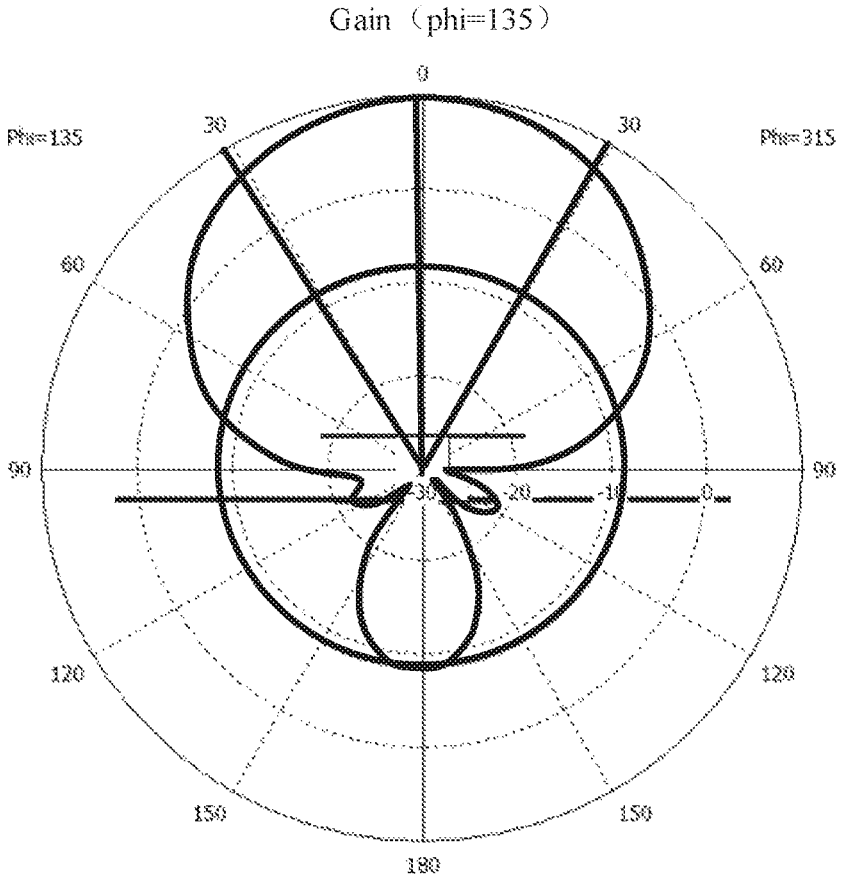
FIG. 9 is illustrates a pattern of the first oscillator unit of the antenna according to the first embodiment of the present application in a plane of Phi=135°.
Figure 10:
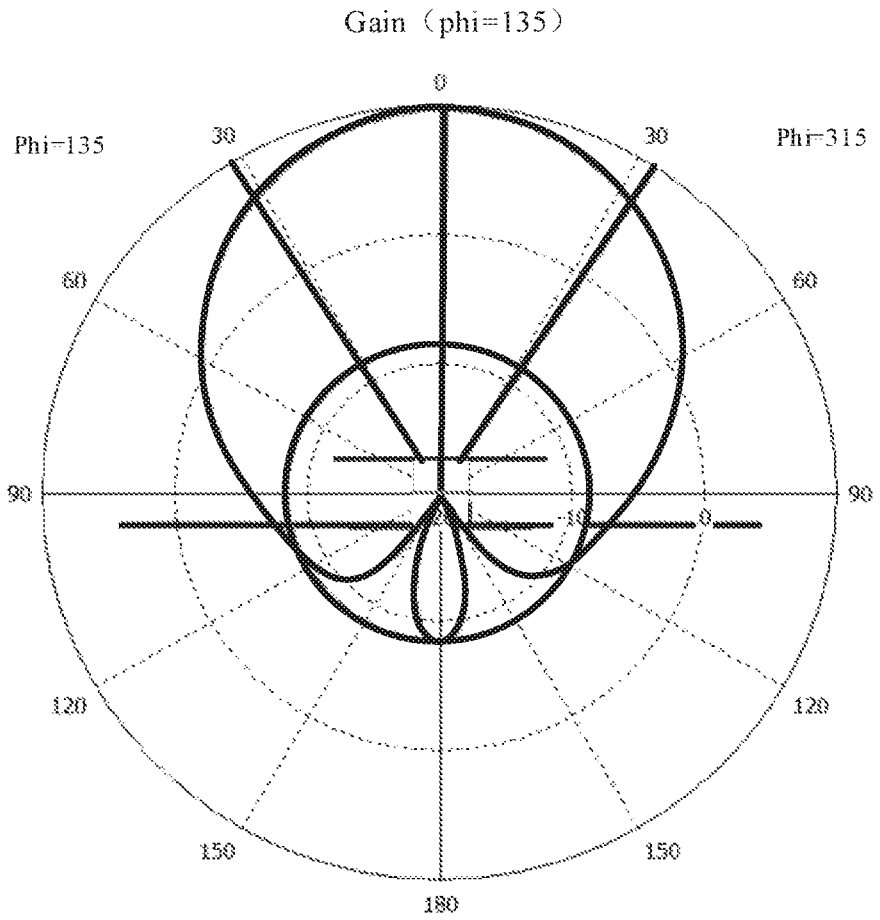
FIG. 10 illustrates a pattern of a second oscillator unit of the antenna according to the first embodiment of the present application in a plane of Phi=135°.
Figure 11:
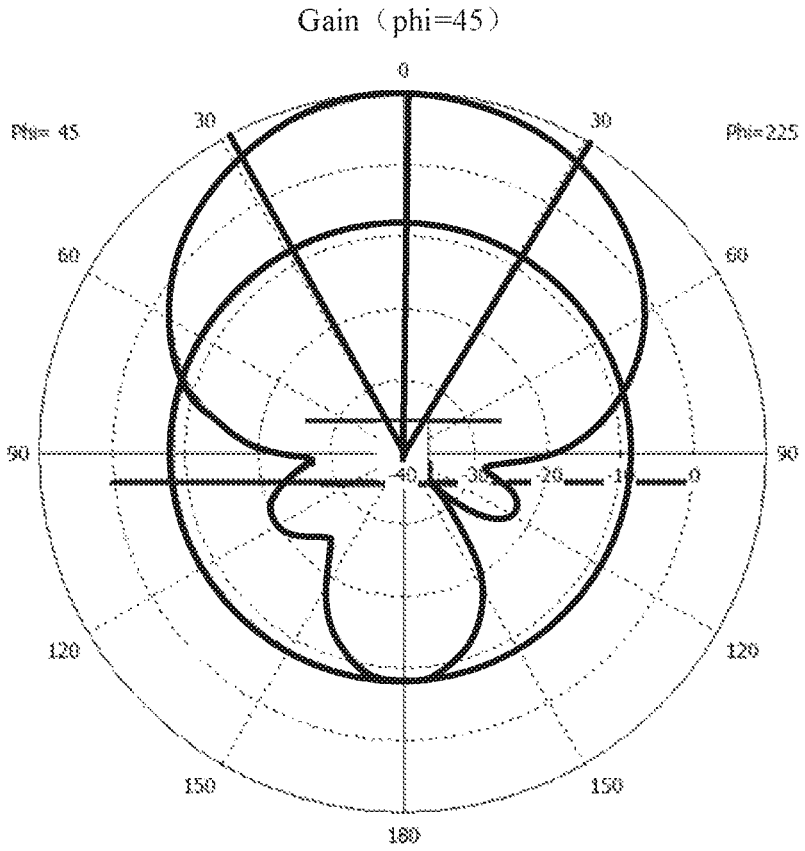
FIG. 11 illustrates a pattern of the second oscillator unit of the antenna according to the first embodiment of the present application in a plane of Phi=45°.

In a particular implementation, as shown in FIG. 5, the radiating bodies of the first oscillator unit and the second oscillator unit are disposed on the surface of the radiating substrate 10, and the first radiating body 11 and the second radiating body 12 of the first oscillator unit are symmetrical with respect to a first symmetry axis 1', and the third radiating body 13 and the fourth radiating body 14 of the second oscillator unit are symmetrical with respect to a second symmetry axis 2', where, the first symmetry axis 1' and the second symmetry axis 2' are vertical to each other. Each radiating body of the first oscillator unit has an axially symmetric structure with respect to the second symmetry axis 2', and each radiating body of the second oscillator unit has an axially symmetric structure with respect to the first symmetry axis 1'. The intersection of the first symmetry axis 1' and the second symmetry axis 2' is a center point O.

In a specific implementation, an orthographic projection of the first feeding substrate 21 of the first oscillator unit on the radiating substrate 10 is aligned with the second symmetry axis 2', and an orthographic projection of the second feeding substrate 31 of the second oscillator unit on the radiating substrate 10 is aligned with the first symmetry axis 1'.

In a particular implementation, the radiating portion 1 of the first oscillator unit and the second oscillator unit have the same structure. Take the first radiating body 11 as an example, the first radiating body 11 includes a conductive region and a non-conductive hollowed-out region arranged in the conductive region. The conductive region includes a right-angled triangular portion 41 adjacent to the center point O, two extending portions 42 extending from two right-angle sides of the right-angled triangular portion 41 in a direction away from the center point, and an arc portion 43 for connecting two extending portions 42, and an expanding portion 44 extending from the center of the arc portion in the direction away from the center point.

Figure 4:
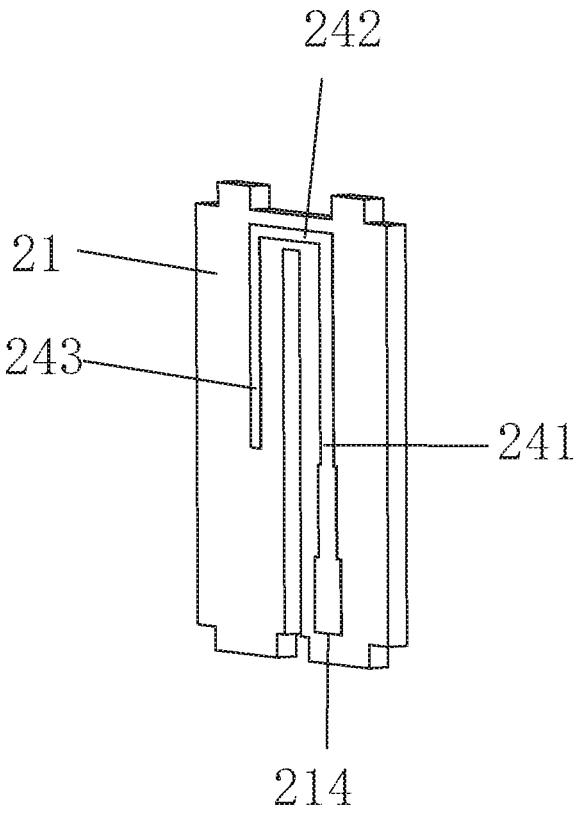
FIG. 4 is a structural diagram of a feeding portion of the antenna according to the first embodiment of the present application.

In a particular implementation, the feeding portions 2 of the first oscillator unit and the second oscillator unit have the same structure. As shown in FIG. 4, take the feeding portion of the first oscillator unit as an example, each feeding portion 2 further includes a feeding port 214 disposed at an end of the feeding substrate away from the radiating substrate 10. The microstrip line 24 of the feeding portion 2 includes a first strip line 241 extending from the feeding port 214 toward the radiating substrate 10, a second strip line 242 extending from an end of the first strip line 241 away from the feeding port 214 in a direction parallel to the radiating substrate 10, and a third strip line 243 extending from an end of the second strip line 242 away from the first strip line 241 in a direction away from the radiating substrate 10.

In a particular implementation, the first polarization of oscillator unit and the second oscillator unit are orthogonal. For example, the first oscillator unit and the second oscillator unit adopt ±45° orthogonal polarization to ensure better isolation degree.

The performance of the above antenna is shown in FIGS. 6-11. As can be seen from the figures, the antenna may cover the band of 3.4-3.8 GHz and has a higher gain.

It should be noted that the above is merely an example and does not limit the technical solution of the present application.

Compared with the prior art, the antenna designed by the present application realizes orthogonal dual polarization and high gain through two crossed-arranged oscillator units, and the antenna has a simple structure, a low profile, and is easy to be arrayed on a base station, increasing the flexibility of network coverage in the base station.

Figure 12:
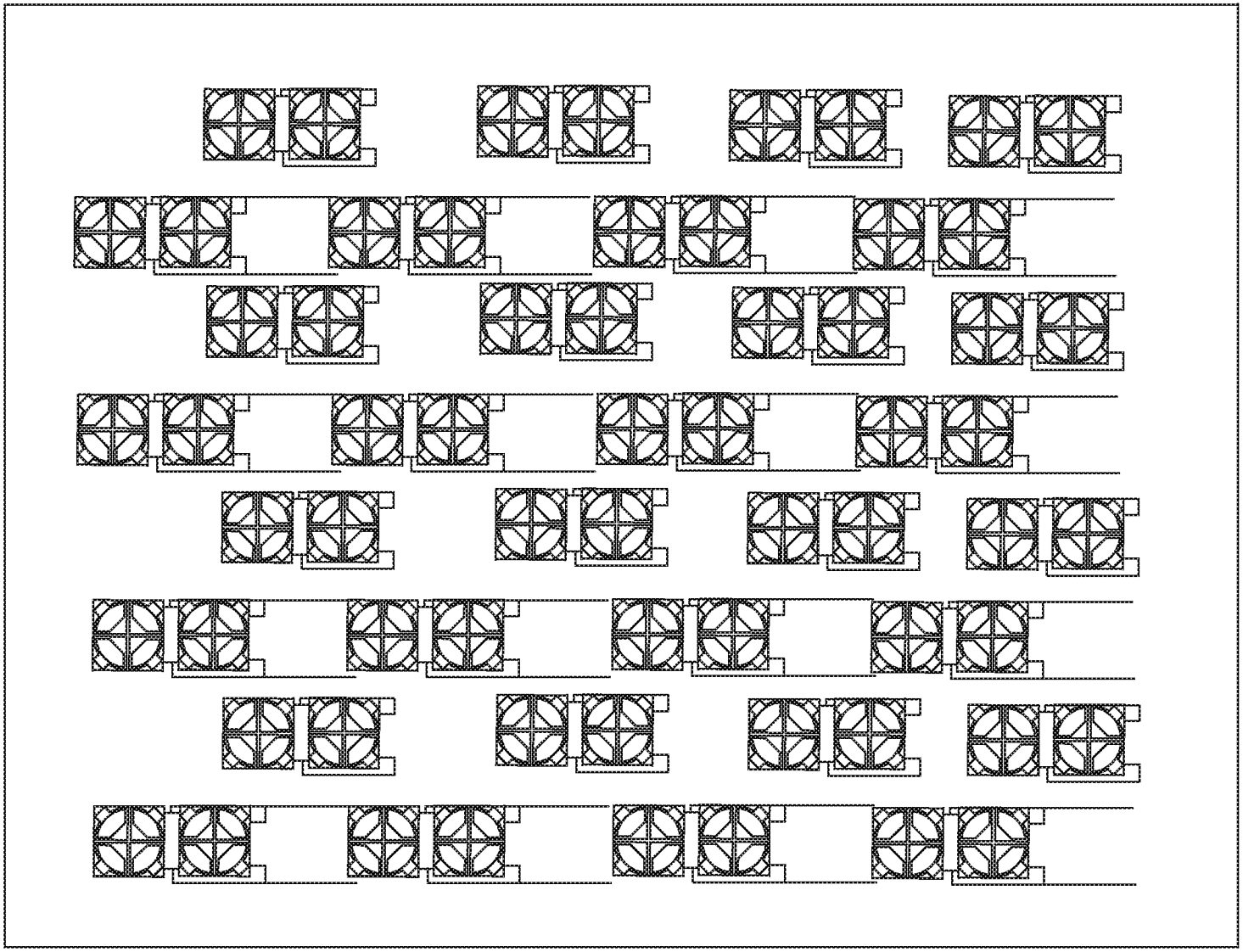
FIG. 12 is a structural diagram of an antenna array according to a second embodiment of the present application.

The second embodiment of the present application relates to an antenna array, and the structure of the antenna array is as shown in FIG. 12. The antenna array includes several antennas according to the first embodiment to form a massive antenna array. In the antenna array, the antennas of respective columns are staggered to save space.

A third embodiment of the present application relates to a base station including the antenna array in the second embodiment described above.

The embodiments provided by the present invention are applicable to the field of the wireless mobile communication base station, and are also applicable to the receiving and transmitting devices of various types of wireless communication systems, and are not specifically limited in this regard.

A person skilled in the art should understand that the above embodiments are specific embodiments for implementing the present application, and in practical use may be varied in various way in form and detail without departing from the spirit and scope of the present application.

What is claimed is:

1. An antenna comprising two pairs of oscillator units that are orthogonal in polarization and have a same structure, each pair of oscillator units comprising a radiating portion and a feeding portion for feeding the radiating portion;

wherein, the radiating portion comprises a radiating substrate and two radiating bodies disposed on a surface of the radiating substrate, wherein, the radiating bodies are spaced apart from and symmetrical to each other; the feeding portion comprises a feeding substrate, a ground disposed on a surface of one side of the feeding substrate and a microstrip line disposed on a surface of the other side of the feeding substrate; and the radiating substrate and the feeding substrate are perpendicular to and connected to each other, the ground is connected to the radiating bodies, and the microstrip line is spaced apart from and coupled to the radiating bodies.

2. The antenna according to claim 1, wherein, the two pairs of the oscillator units comprise a first oscillator unit and a second oscillator unit, and the radiating bodies of the first oscillator unit and the second oscillator unit are disposed on a same surface of a same radiating substrate; the two radiating bodies of the first oscillator unit are symmetrical with respect to a first symmetry axis, and the two radiating bodies of the second oscillating unit are symmetrical with respect to a second symmetry axis, and the first symmetry axis and the second symmetry axis are perpendicular to each other; and each of the radiating bodies of the first oscillator unit has an axially symmetric structure with respect to the second symmetry axis, and each of the radiating bodies of the second oscillator units has an axially symmetric structure with respect to the first symmetry axis.

3. The antenna according to claim 2, wherein an orthographic projection of the feeding substrate of the first oscillator unit on the radiating substrate is aligned with the second symmetry axis, and an orthographic projection of the feeding substrate of the second oscillator unit on the radiating substrate is aligned with the first symmetry axis.

4. The antenna according to claim 3, wherein each of the feeding portions further comprises a feeding port disposed at an end of the feeding substrate away from the radiating substrate, the microstrip line of each of the feeding portions comprises a first strip line extending from the feeding port in a direction toward the radiating substrate, a second strip line extending from an end of the first strip line away from the feeding port in a direction parallel to the radiating substrate, and a third strip line extending from an end of the second strip line away from the first strip line in a direction away from the radiating substrate.

5. The antenna according to claim 4, wherein an intersection of the first symmetry axis and the second symmetry axis is a center point, and each of the radiating bodies comprises a conductive region and a non-conductive hollowed-out region arranged in the conductive region, the conductive region comprises a right-angled triangular portion adjacent to the center point, two extending portions extending from two right-angle sides of the right-angled triangular portion in a direction away from the center point, an arc portion for connecting the two extending portions, and an expansion portion extending from a center of the arc portion in the direction away from the center point.

6. The antenna according to claim 1, wherein the ground is connected to the right-angled triangular portion.

7. The antenna according to claim 1, wherein the radiating substrate and the feeding substrate are snap-fitted.

8. The antenna according to claim 1, wherein the feeding substrates of two of the oscillator units are snap-fitted.

9. An antenna array comprising at least one antenna, the antenna comprising two pairs of oscillator units that are orthogonal in polarization and have a same structure, each pair of oscillator units comprising a radiating portion and a feeding portion for feeding the radiating portion;

wherein, the radiating portion comprises a radiating substrate and two radiating bodies disposed on a surface of the radiating substrate, wherein, the radiating bodies spaced apart from and symmetrical to each other; the feeding portion comprises a feeding substrate, a ground disposed on a surface of one side of the feeding substrate and a microstrip line disposed on a surface of the other side of the feeding substrate; and the radiating substrate and the feeding substrate are perpendicular to and connected to each other, the ground is connected to the radiating bodies, and the microstrip line is spaced apart from and coupled to the radiating bodies.

10. The antenna array according to claim 9, wherein, the two pairs of the oscillator units comprise a first oscillator unit and a second oscillator unit, and the radiating bodies of the first oscillator unit and the second oscillator unit are disposed on a same surface of a same radiating substrate; the two radiating bodies of the first oscillator unit are symmetrical with respect to a first symmetry axis, and the two radiating bodies of the second oscillating unit are symmetrical with respect to a second symmetry axis, and the first symmetry axis and the second symmetry axis are perpendicular to each other; and each of the radiating bodies of the first oscillator unit has an axially symmetric structure with respect to the second symmetry axis, and each of the radiating bodies of the second oscillator units has an axially symmetric structure with respect to the first symmetry axis.

11. The antenna array according to claim 10, wherein an orthographic projection of the feeding substrate of the first oscillator unit on the radiating substrate is aligned with the second symmetry axis, and an orthographic projection of the feeding substrate of the second oscillator unit on the radiating substrate is aligned with the first symmetry axis.

12. The antenna array according to claim 11, wherein each of the feeding portions further comprises a feeding port disposed at an end of the feeding substrate away from the radiating substrate, the microstrip line of each of the feeding portions comprises a first strip line extending from the feeding port in a direction toward the radiating substrate, a second strip line extending from an end of the first strip line away from the feeding port in a direction parallel to the radiating substrate, and a third strip line extending from an end of the second strip line away from the first strip line in a direction away from the radiating substrate.

13. The antenna array according to claim 12, wherein an intersection of the first symmetry axis and the second symmetry axis is a center point, and each of the radiating bodies comprises a conductive region and a non-conductive hollowed-out region arranged in the conductive region, the conductive region comprises a right-angled triangular portion adjacent to the center point, two extending portions extending from two right-angle sides of the right-angled triangular portion in a direction away from the center point, an arc portion for connecting the two extending portions, and an expansion portion extending from a center of the arc portion in the direction away from the center point.

14. The antenna array according to claim 9, wherein the ground is connected to the right-angled triangular portion.

15. The antenna array according to claim 9, wherein the radiating substrate and the feeding substrate are snap-fitted.

16. The antenna array according to claim 9, wherein the feeding substrates of two of the oscillator units are snap-fitted.

17. A base station comprising an antenna array, the antenna array comprising at least one antenna, wherein, the antenna comprises two pairs of oscillator units that are orthogonal in polarization and have a same structure, each pair of oscillator units comprises a radiating portion and a feeding portion for feeding the radiating portion;

wherein, the radiating portion comprises a radiating substrate and two radiating bodies disposed on a surface of the radiating substrate, wherein, the radiating bodies spaced apart from and symmetrical to each other; the feeding portion comprises a feeding substrate, a ground disposed on a surface of one side of the feeding substrate and a microstrip line disposed on a surface of the other side of the feeding substrate; and the radiating substrate and the feeding substrate are perpendicular to and connected to each other, the ground is connected to the radiating bodies, and the microstrip line is spaced apart from and coupled to the radiating bodies.

* * * * *